US012410943B2

(12) United States Patent
Larson et al.

(10) Patent No.: US 12,410,943 B2
(45) **Date of Patent: *Sep. 9, 2025**

(54) HEATING, VENTILATION, AND AIR CONDITIONING SYSTEM WITH TIERED MULTI-LEVEL BASE PAN

(71) Applicant: Goodman Manufacturing Company, L.P., Waller, TX (US)

(72) Inventors: Larry Larson, Spring, TX (US); Michael F Taras, The Woodlands, TX (US); Robert Yosenick, Cypress, TX (US); David Boyea, Houston, TX (US); Abdalla Elraghy, Houston, TX (US)

(73) Assignee: Goodman Manufacturing Company, L.P., Waller, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/733,541

(22) Filed: Jun. 4, 2024

(65) Prior Publication Data

US 2024/0318864 A1 Sep. 26, 2024

Related U.S. Application Data

(63) Continuation of application No. 17/373,979, filed on Jul. 13, 2021.

(51) Int. Cl.

| | |
|---|---|
| ***F24F 13/32*** | (2006.01) |
| ***F24F 13/20*** | (2006.01) |
| ***F24F 13/22*** | (2006.01) |
| ***F24F 13/30*** | (2006.01) |

(52) U.S. Cl.

CPC ..... *F24F 13/32* (2013.01); *F24F 13/20* (2013.01); *F24F 13/22* (2013.01); *F24F 13/222* (2013.01); *F24F 13/30* (2013.01); *F24F 2013/202* (2013.01)

(58) Field of Classification Search

CPC .. F24F 13/32; F24F 13/20; F24F 13/22; F24F 13/222; F24F 13/30; F24F 2013/202; F24F 1/10; F24F 1/36; F24F 1/56

See application file for complete search history.

(56) References Cited

FOREIGN PATENT DOCUMENTS

KR 200178858 Y1 * 5/2000

* cited by examiner

*Primary Examiner* — Kun Kai Ma
(74) *Attorney, Agent, or Firm* — K&L Gates LLP

(57) ABSTRACT

A heating, ventilation, and air conditioning (HVAC) system includes one or more compressors, one or more outdoor heat exchangers, and one or more indoor heat exchangers. The HVAC system also includes a base pan on which the one or more compressors are mounted. The base pan includes a base level and one or more tier levels higher than the base level. The distance from any point on a perimeter of the first-tier level to a nearest point on a perimeter of the base level is based on the smallest bolt circle diameter of the one or more compressors mounted on the base pan. Also, the perimeter lengths of the tier levels are based on a percentage of the base level perimeter length.

20 Claims, 4 Drawing Sheets

HEATING, VENTILATION, AND AIR CONDITIONING SYSTEM WITH TIERED MULTI-LEVEL BASE PAN

BACKGROUND

This section is intended to provide relevant background information to facilitate a better understanding of the various aspects of the described embodiments. Accordingly, these statements are to be read in this light and not as admissions of prior art.

Typically, one or more refrigerant compressors of a heating, ventilation, and air conditioning (HVAC) system is mounted on a base pan designed to support these one or more compressors. Base pans can potentially be insufficiently structurally supportive such that the base pan sags, especially with the compressor and other HVAC system components such as accumulator mounted on top of the base pan. This sag can present the problem of collecting water, which over time can damage the base pan, as well as HVAC system components attached to the base pan. Further, some base pan designs suffer from vibration fatigue from the compressor or compressors during operation, which can be increased if the vibration frequency of the compressor happens to be a resonant frequency of the base pan. Vibration of the base pan from operation of the compressor or compressors can also damage the base pan over time. Additionally, during shipment, the compressor or other components of the HVAC system tends to vibrate more violently than during normal operation of the air conditioning unit. Base pans that allow excess movement and vibration during shipping may result in damage to the HVAC system components such as compressors and accumulators, and the base pan. Such vibrations during operation or shipping can also lead to failure in the piping system and other system components due to the high stresses generated by induced structural loads and displacements. HVAC systems can be shipped from the factory with the compressor "tied down" against the base pan to prevent damage while the unit is in transit. However, vibration of a "tied down" compressor may still lead to damage to the base pan. In addition, tying down the compressor requires additional time when preparing the air conditioning unit for shipment and then when installing the unit to tighten and loosen the compressor, as needed. Additional costs associated with these extra steps are also incurred. Furthermore, excessive vibration may cause undesired noise propagating into the conditioned environment and causing environmental disturbance.

An HVAC system with a robust base pan is needed that is cost effective and can be efficiently assembled for shipment and operation.

BRIEF DESCRIPTION OF THE DRAWINGS

Embodiments of the HVAC system with a tiered multi-level base pan are described with reference to the following figures. The same or sequentially similar numbers are used throughout the figures to reference like features and components. The features depicted in the figures are not necessarily shown to scale. Certain features of the embodiments may be shown exaggerated in scale or in somewhat schematic form, and some details of elements may not be shown in the interest of clarity and conciseness.

DETAILED DESCRIPTION

The present disclosure describes a heating, ventilation, and air conditioning (HVAC) system with one or more compressors mounted onto a tiered multi-level base pan. Although the general description of this invention is referenced to the HVAC system compressors mounted on the base pan, other refrigerant system components including but not limited to accumulators, receivers, charge compensators, flow control devices, air movers, pumps, and filter driers can be structurally attached to the base pan and may require similar treatment. The design of the base pan is configured such that the vertical forces from the compressor(s) mounted on the base pan are evenly distributed across the base pan and transmitted from the center of the base pan outward to the perimeter of the base pan. The geometry of each tiered level is optimized to minimize the amount of flat, unsupported material, which results in minimized deflection of the base pan under load from the mounted compressor, as well as allowing any accumulated water to drain towards the unit periphery and be discharged outside of the unit boundaries. The tiered multi-level design includes a base level and at least one tier level higher than the base level. The base pan may also be supported by one or more base level support structures, typically near or along a perimeter of the base level. A distance from a perimeter of the first tier level to the perimeter of the base level or a base level support structure is based on the smallest bolt circle diameter of the compressor(s). Further, the tier level perimeter lengths are based on a percentage of the base level perimeter length. Further, the base pan includes one or more compressor structural supports and the distance from a center of one of the compressors to the closest compressor structural support is equal to two times the smallest bolt circle diameter or less.

The geometry of the base level and each tier level is optimized to balance the forces from the compressor(s), thus minimizing side-to-side motion of the compressor(s) and keeping the motion of the compressor(s) limited and linear in the vertical direction. The linear motion means all compressor feet move in unison, spreading out the load of each compressor evenly and minimizing stress concentrations in the base pan. The vertical motion also minimizes torsional stresses in associated connection tubing, since the combination of bending and torsional stresses accelerates fatigue failure in the connecting refrigerant tubing. The resulting structure also dampens harmonics that may amplify during transit of the system. The tiered design also ensures that any water on the base pan surface drains toward the outside of the base pan. As noted above, analogous conclusions can be drawn regarding other HVAC system components, such accumulators, receivers, charge compensators, flow control devices, air movers, pumps, and filter driers structurally attached to the base pan and requiring similar treatment.

Figure 1A:
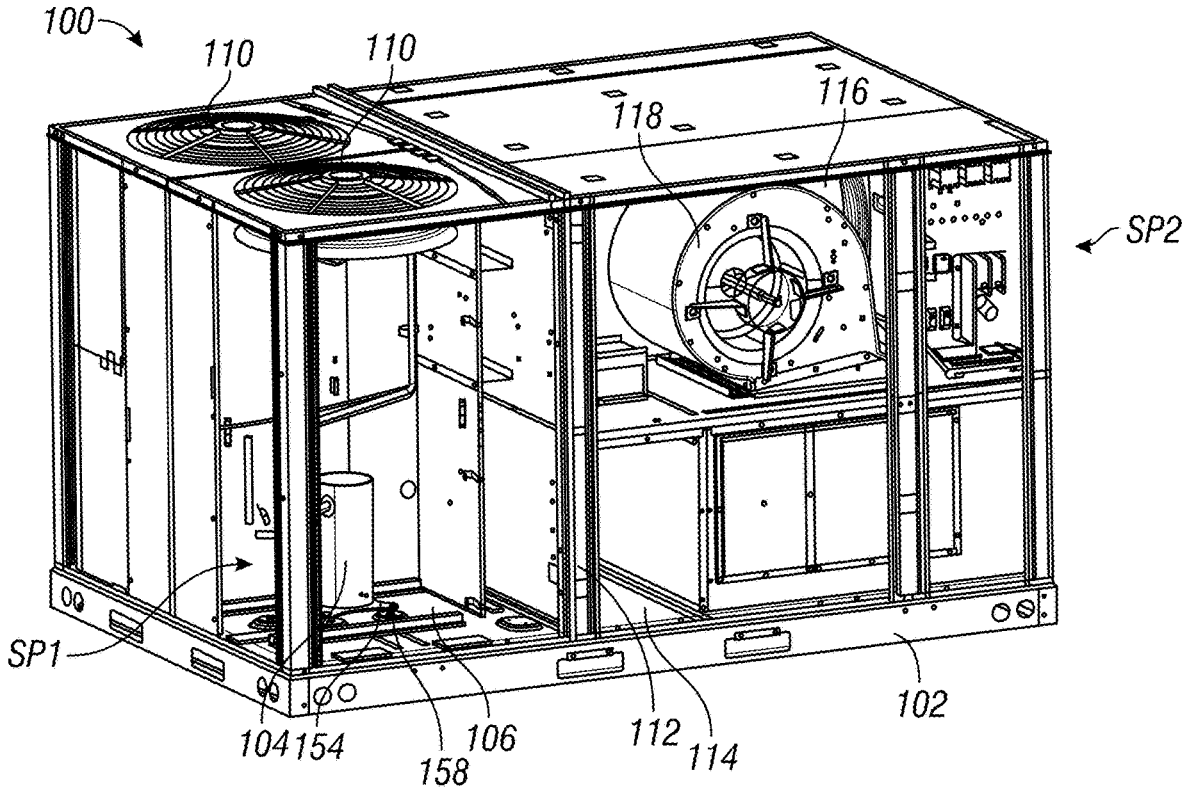
FIGS. 1A and 1B are a perspective and cross-section views of a heating ventilation and air conditioning (HVAC) system, according to one or more embodiments.
Figure 1B:
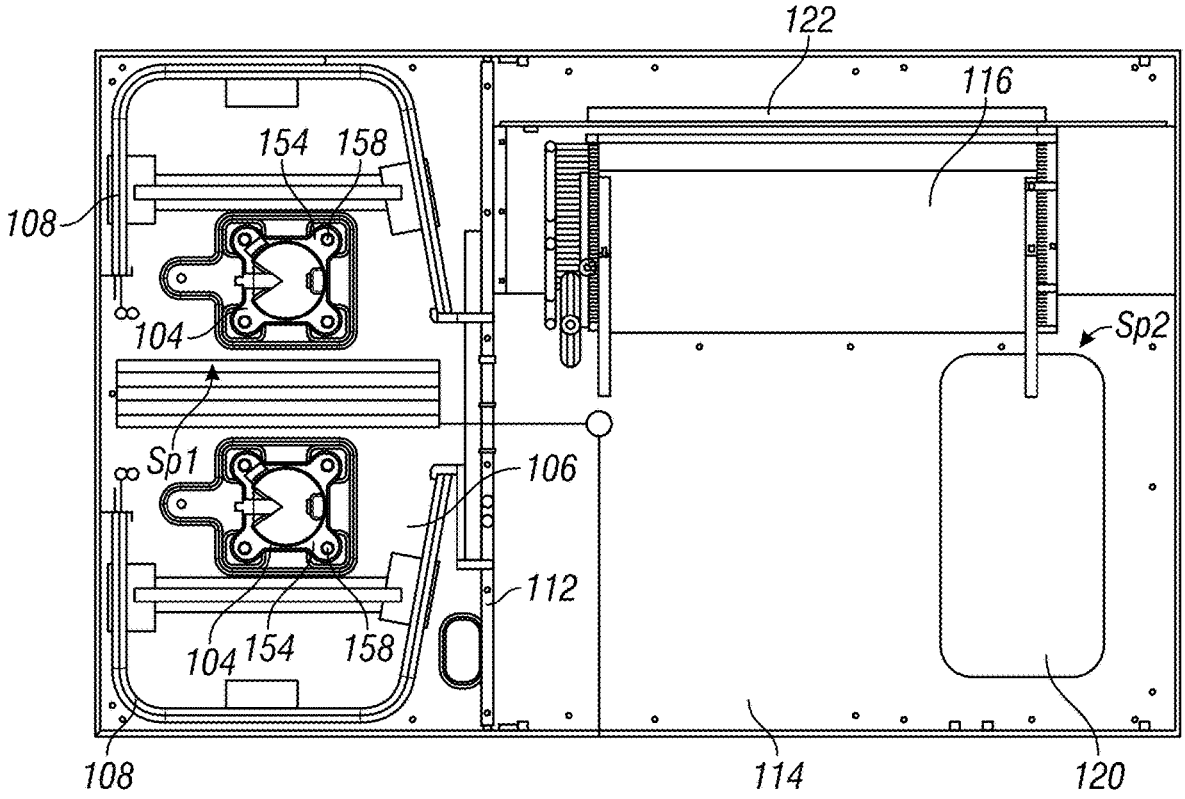

Turning now the figures, FIGS. 1A and 1B show an external appearance of an HVAC system 100 when seen from obliquely above the HVAC system 100 as well as a cross-section view of the HVAC system 100 from a top view perspective. Although not shown, it should be appreciated that the HVAC system 100 includes additional panel covers for covering and protecting the equipment of the HVAC system 100. The example HVAC system 100 shown is a so-called "light" commercial package unit and shall be described in terms of a cooling operation, although it should be appreciated that the HVAC system 100 could also be used for heating and can be representing residential packaged, residential split, light commercial split, or commercial applied applications. The HVAC system 100 includes both an "outdoor" section SP1 and an "indoor" section SP2 mounted on a common frame 102.

The outdoor section SP1 includes one or more compressors 104 mounted on a base pan 106. As noted above, the outdoor section SP1 may include other HVAC system components, such accumulators, receivers, charge compensators, flow control devices, air movers, pumps, and filter driers structurally attached to the base pan (not shown). Also included are one or more outdoor heat exchangers 108 and outdoor fans 110 that move air into the outdoor section SP1 across the outdoor heat exchanger 108 and to the outside of the HVAC system 100. FIG. 1A is shown without the additional outdoor heat exchanger 108 and outdoor fan 110 to be able to view additional structure and equipment. However, FIG. 1B shows the additional outdoor heat exchanger 108 and it should be appreciated that an additional outdoor fan 110 would be included as well. The outdoor fans 110 may be any suitable type of fan, for example, a propeller fan. The outdoor heat exchangers 108 may include a plurality of heat-transfer tubes (not shown) in which a refrigerant flows and a plurality of heat-transfer fins (not shown) in which air flows between gaps thereof. The plurality of heat-transfer tubes may be arranged in an up-down direction (hereunder may be referred to as "row direction"), and each heat-transfer tube may extend in a direction substantially orthogonal to the up-down direction (in a substantially horizontal direction). At an end portion of the outdoor heat exchangers 108, for example, the heat-transfer tubes are connected to each other by being bent into a U-shape or by using a U-shaped return bends so that the flow of a refrigerant from a certain column to another column and/or a certain row to another row is turned back. The plurality of heat-transfer fins that extend so as to be long in the up-down direction are arranged side by side in a direction in which the heat-transfer tubes extend with a predetermined interval between the plurality of heat-transfer fins. The plurality of heat-transfer fins and the plurality of heat-transfer tubes are assembled to each other so that each heat-transfer fin extends through the plurality of heat-transfer tubes. The plurality of heat-transfer fins are also disposed in a plurality of columns.

Due to the structure of the outdoor heat exchangers 108, a flow path of outdoor air that enters the outdoor space SP1 passes through the outdoor heat exchanger 108*s*, where the outdoor air exchanges heat with a refrigerant that flows in the outdoor heat exchangers 108. Air after the heat exchange in the outdoor heat exchanger 108 is discharged to the outside of the outdoor space SP1 by the outdoor fans 110.

The outdoor space SP1 and the indoor space SP2 are separated by a partition plate 112. Outdoor air flows to the outdoor space SP1 and indoor air flows to the indoor space SP2. By separating the outdoor space SP1 and the indoor space SP2 by the partition plate 112, the airflow bypass between the outdoor space SP1 and the indoor space SP2 is blocked. Therefore, in an ordinary state, the indoor air and the outdoor air do not mix and do not communicate with each other within or via the HVAC system 100. It has to be noted, that there exist the airside economizers that allow mixing indoor and outdoor air, however there are not discussed in relation to this invention.

Although not shown, the indoor section SP2 includes an expansion valve and a combustion heat exchanger located within a cabinet of the indoor section SP2. The expansion valve may alternatively be located in the outdoor section SP1. The indoor section SP2 also includes an indoor heat exchanger 116 and an indoor blower 118, which may be, for example, a centrifugal fan. The indoor heat exchanger 116 may also include a plurality of heat-transfer tubes in which a refrigerant flows, and a plurality of heat-transfer fins in which air flows between gaps thereof. The plurality of heat-transfer tubes may be arranged in an up-down direction (row direction), and each heat-transfer tube may extend in a direction substantially orthogonal to the up-down direction (in the second embodiment, in a left-right direction). At an end portion of the indoor heat exchanger 116, for example, the heat-transfer tubes are connected to each other by being bent into a U-shape or by using a U-shaped return bends so that the flow of a refrigerant from a certain column to another column and/or a certain row to another row is turned back. The plurality of heat-transfer fins and the plurality of heat-transfer tubes may be assembled so that each heat-transfer fin extends through the plurality of heat-transfer tubes.

The indoor heat exchanger 116 divides the indoor space SP2 into a space on an upstream side with respect to the indoor heat exchanger 116 and a space on a downstream side with respect to the indoor heat exchanger 116. All air that flows to the downstream side from the upstream side with respect to the indoor heat exchanger 116 passes through the indoor heat exchanger 116. The indoor blower 118 is disposed in the space on the downstream side with respect to the indoor heat exchanger 116 and causes an airflow that passes through the indoor heat exchanger 116 to be generated. Although not shown, supply air and return air ducts are connected to the indoor space SP2 through a bottom plate 114 in the bottom of the HVAC system 100. The blower 118 is disposed above a supply air opening 120 in the bottom plate 114 for providing supply air to the indoor space being cooled. A return air opening 122 in the bottom plate 114 provides return air from the indoor space being cooled to flow through the indoor heat exchanger 116 and the indoor blower 118.

The HVAC system 100 also includes a refrigerant circuit that includes the indoor heat exchanger 116 and the outdoor heat exchangers 108. In the refrigerant circuit, a refrigerant circulates between the indoor heat exchanger 116 and the outdoor heat exchangers 108. In the refrigerant circuit, when, in a cooling operation or a heating operation, a vapor compression refrigeration cycle is performed, heat is exchanged at the indoor heat exchanger 116 and the outdoor heat exchangers 108. The refrigerant circuit includes the compressors 104, the outdoor heat exchangers 108, the expansion valve, and the indoor heat exchanger 116. At the time of the cooling operation, a refrigerant is compressed by the compressors 104 and is sent to the outdoor heat exchangers 108. The refrigerant dissipates heat to outdoor air at the outdoor heat exchangers 108 and is sent to the expansion valve. At the expansion valve, the refrigerant expands and its pressure and temperature are reduced, and is then sent to the indoor heat exchanger 116. A refrigerant having a low temperature and a low pressure sent from the expansion valve exchanges heat at the indoor heat exchanger 116, and absorbs heat from indoor air. The air cooled by having its heat taken away at the indoor heat exchanger 116 is supplied to the indoor space being cooled. The refrigerant after the heat exchange at the indoor heat exchanger 116 is then sucked into the compressors 104 to repeat the cycle.

The equipment of the refrigerant circuit, and thus flow of the refrigerant through the circuit may be controlled by a main controller that controls the HVAC system 100. The main controller may also be configured to be capable of communicating with a remote controller. A user can send, for example, a set values of indoor temperatures of rooms in the indoor space being cooled to the main controller from the remote controller. For controlling the HVAC system 100, a plurality of temperature sensors for measuring the temperature of a refrigerant at each portion of the refrigerant circuit and/or a pressure sensor that measures the pressure of each portion and a temperature sensor for measuring the air temperature of each location may be provided.

The main controller performs at least on/off control of the compressors 104, on/off control of the outdoor fans 110, and on/off control of the indoor bower 118. When any or all of the compressors 104, the outdoor fans 110, and the indoor blower 118 include a motor of a type whose number of rotations is changeable, the main controller may be configured to be capable of controlling the number of rotations of the motor or motors whose number of rotations is changeable among the motors of the compressors 104, the outdoor fans 110, and the indoor blower 118. In this case, the main controller can control the circulation amount of the refrigerant that flows through the refrigerant circuit by changing the number of rotations of the motor of the compressors 104. The main controller can change the flow rate of outdoor air that flows between the heat-transfer fins of the outdoor heat exchangers 108 by changing the number of rotations of the motor of the outdoor fans 110. The main controller can change the flow rate of indoor air that flows between the heat-transfer fins of the indoor heat exchanger 116 by changing the number of rotations of the motor of the indoor blower 118.

The main controller may be realized by, for example, a computer. The computer that constitutes the main controller includes a control calculation device and a storage device. For the control calculation device, a processor such as a CPU or a GPU may be used. The control calculation device reads a program that is stored in the storage device and performs a predetermined image processing operation and a computing processing operation in accordance with the program. Further, the control calculation device writes a calculated result to the storage device and reads information stored in the storage device in accordance with the program. However, the main controller may be formed by using an integrated circuit (IC) that can perform control similar to the control that is performed by using a CPU and a memory. Here, IC includes, for example, LSI (large-scale integrated circuit), ASIC (application-specific integrated circuit), a gate array, and FPGA (field programmable gate array).

FIGS. 1A and 1B illustrate the compressors 104 being a vertically oriented, generally cylindrical body supported by support structures 154. The support structures 154 include a plurality of outwardly projecting "feet", each of which has an opening 158 formed therein for attaching to the base pan 106 through appropriate fasteners or structurally supported interfaces.

The base pan 106 may be manufactured from a sheet metal material. Alternatively, the base pan 106 be any material suitable for supporting the HVAC system 100 and may be manufactured by any suitable process, such as press-forming or additive manufacturing. The portion of the base pan 106 to which the compressor 104 is mounted, includes a plurality of holes complementary to the openings 158 of the feet of the support structure 154. A fastener may be inserted through each hole in the base pan 106 and through an adjacent opening 158 in the support structure 154 to couple the compressor 104 to the base pan 106. Additionally, although the base pan 106 and the bottom plate 114 are shown as separate, the base pan and the bottom plate may be integrally formed together to support equipment in both the outdoor space SP1 and the indoor space SP2.

Figure 2A:
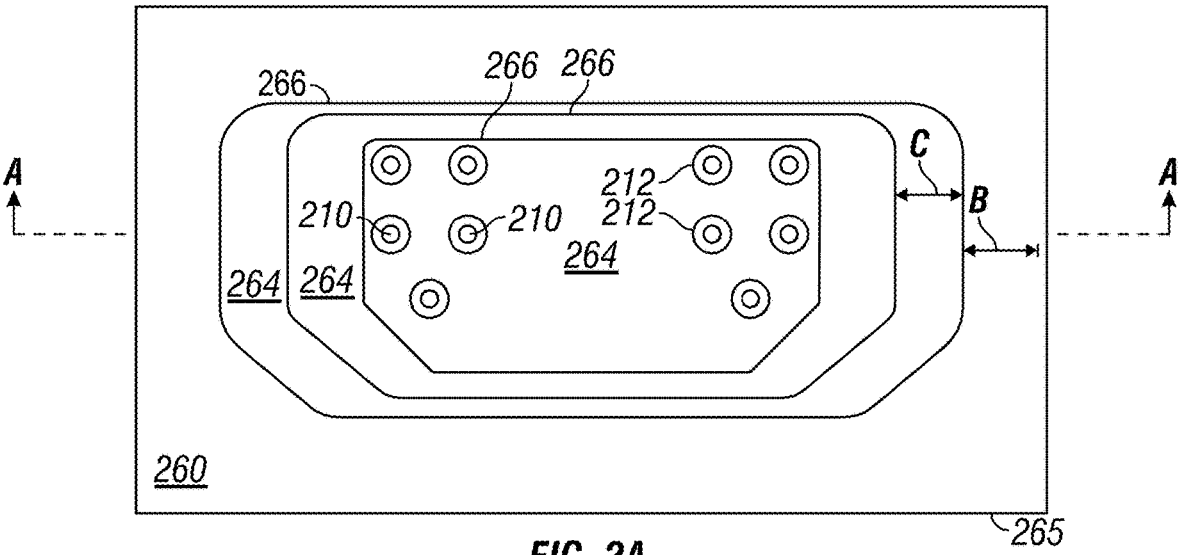
FIGS. 2A and 2B are a top and cross section-views of an embodiment of a base pan for use in an HVAC system.
Figure 2B:
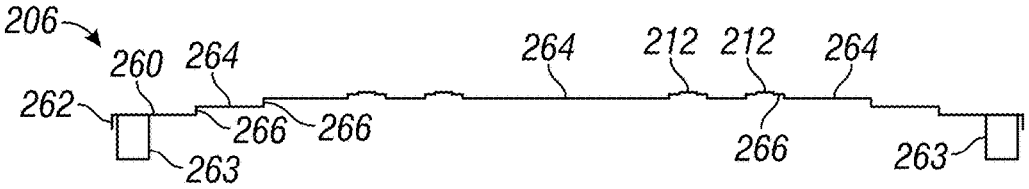

FIG. 2A shows a top view of an embodiment of a tiered multi-level base pan 206 for use with an HVAC system such as the HVAC system 100 discussed above. FIG. 2B shows a cross-section view of the tiered multi-level base pan 206 taken through plane A-A. As shown, the base pan 206 includes a base level 260 that forms the base structure of the base pan 206. Although shown shaped as a rectangle, the base level 260 could be shaped is any suitable form. The base level 260 also includes a wall 262 extending downward that surrounds the perimeter of the base level 260 and helps support the load of the base pan 206 itself as well as the compressor and other HVAC system components when mounted onto the base pan 206. Underneath the base pan 206 are base level support structures 263. Although two base level support structures 263 are shown, it should be appreciated the base pan may only include one or more than two base level support structures 263. During shipment of an HVAC system and in final installation, the base pan 206 may be placed on and supported by the base level support structures 263 underneath the base pan 206. As an example, the base level support structures may include rails for supporting the base pan 206.

The base pan 206 includes at least one tier level 264 higher than the base level 260 and connected by a wall 266. The wall 266 need not be completely perpendicular to the flat surfaces of the base level 260 and the tier level 264 but instead may be formed at an angle to perpendicular other than flat. Additionally, the transition from flat surface to wall and back to flat surface may be any suitable transition, such as a curved transition. As shown, the base pan 206 includes optional additional tier layers 264, each increasing in height from the previous tier layer 264 and connected to the previous tier layer 264 by a wall 266.

The portion of the base pan 206 to which the compressor is mounted includes a plurality of holes 210 for mounting one or more compressors on top of the base pan 206. The holes 210 are shown extending through compressor structural supports 212 raised from the highest tier level 264. While the compressor structural supports 212 are shown as circular in shape, the structural supports 212 may be of any suitable shape and also may be sized such that more than one hole 210 extends through a compressor structural support 212. The compressor(s) may also be mounted using less than all of the holes 210. Each compressor that will be mounted to the base pan 206 has a "bolt circle," which is a circle that surrounds all of the holes 210 needed to mount a particular compressor. The holes 210 may be placed to accommodate compressors with different size bolt circles such that a configuration of the holes 210 may be used to mount compressors with different mounting locations without having to redesign the base pan 206.

As mentioned above, the design of the base pan 206 is configured such that the vertical forces from the compressor(s) mounted on the base pan 206 are evenly distributed across the base pan 206 and transmitted from the center of the base pan 206 outward to the perimeter 265 of the base pan 206. The geometry of the base level 260 and each tier level 264 is optimized to minimize the amount of flat, unsupported material, which results in minimized deflection of the base pan 206 under load from the mounted compressor.

One aspect of the design of the base pan 206 is that a distance B from any point on a perimeter of a tier level 264 to a nearest point on a perimeter 265 of the base level 260 or a base level support structure is based on a diameter of the bolt circle of the compressor to be mounted to the base pan 206. For example, the distance from any point on the perimeter of the first tier level 264 to the nearest point on the perimeter 265 of the base level 260 is equal to two times the diameter of the bolt circle or less. If the bolt circle were 10.61 inches (0.269 m), then the distance would be 21.22 inches (0.564 m) or less. For another example, this distance may be the diameter of the compressor bolt circle or less. For a bolt circle of 10.61 inches (0.269 m), then the distance would be 10.61 inches (0.269 m) or less. If more than one compressor is to be mounted on the base pan 206, then the distance from any point on the perimeter of the first tier level 264 to the nearest point on the perimeter 265 of the base level 260 is based on the smallest of the diameters of the bolt circles of the compressors. If there is more than one tier level 264, e.g., second and third tier levels 264, a distance from any point on the perimeter of any tier level 264 and the nearest point on the perimeter of the adjacent tier level 264, for example distance C, is the diameter of the bolt circle of the compressor or less. For a bolt circle of 10.61 inches (0.269 m), then the distance would be 10.61 inches (0.269 m) or less. For example, this distance may be half of the diameter of the compressor bolt circle or less. For a bolt circle of 10.61 inches (0.269 m), then the distance would be 5.31 inches (0.135 m) or less.

Another aspect of the design of the base pan 206 is that the length of the perimeter of any tier level 264 is based on a percentage of the length of the perimeter 265 of the base level 260. For example, the length of the perimeters of the tier levels 264 range from 15% to 70% of the length of the perimeter 265 of the base level 260. For example, the length of the perimeter of the tier levels 264 may be 60-70%, 45-55%, and 30-40% of the length of the perimeter 265 of the base level 260. For example, the length of the perimeter of the first tier level 264 may be 60% to 70% of the length of the perimeter 265 of the base level 260. The percentage of the length of the base level 260 for the length of the perimeter of any tier level 264 may also be selected based on the particular tier level number, e.g., tier level one, tier level two, etc. and expressed by:

$$\%\text{ of length of base level } \textit{perimter} = 1-(0.2+.15*(\text{tier level number})) \quad \text{(Eq. 1)}$$

and includes up to and including +/−5% of the calculated percentage. This concept may be applied even if more or fewer tier levels 264 are used than shown in FIGS. 2A and 2B.

Another aspect of the design of the base pan 206 is that the base pan 206 includes one or more compressor structural supports 212 and the distance from a center of the compressor to the closest compressor structural support 212 is equal to or less than two times the diameter of the bolt circle of the compressor. For example, this distance may be equal to or less than the diameter of the bolt circle of the compressor. If more than one compressor is to be mounted on the base pan 206, then the distance from a center of either compressor to the closest compressor structural support 212 is based on the smallest of the diameters of the bolt circles of the compressors.

Figure 3:
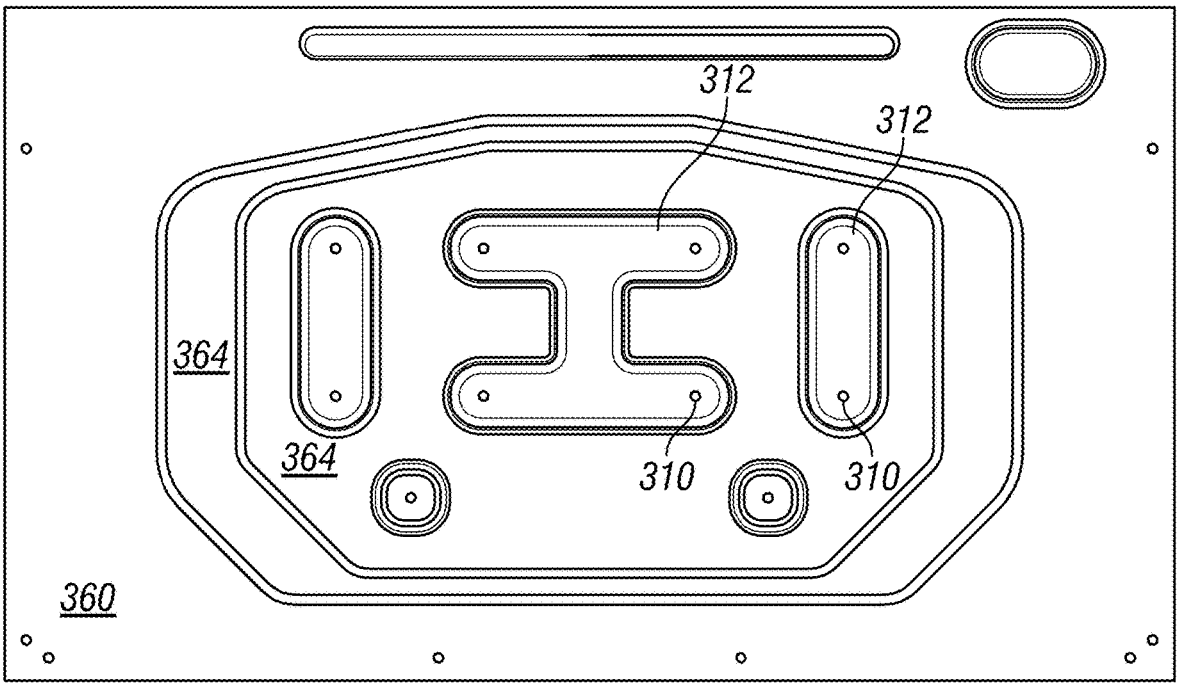
FIG. 3 is a top view of another embodiment of a base pan for use in an HVAC system.

FIG. 3 shows a top view of an alternative embodiment of a tiered base pan 306 for use with an HVAC system such as the HVAC system 100 discussed above. The base pan 306 is designed according to the same principles used in designing the base pan 206 discussed above. However, the base pan 306 includes a base level 360 and only two tier levels 364 compared to three tier levels shown in the base pan 206. The base pan 306 further includes compressor structural supports 312 with holes 310 for mounting one or more compressors. However, some of the compressor structural supports 312 include more than one hole 310 each rather than just one hole each as shown in the base pan 206.

The embodiments of the base pans 206 and 306 shown in FIGS. 2A, 2B, and 3 show that there are multiple possible designs of the tiered based pan in accordance with the listed design principles. Each designed base pan includes a base level and at least one tier level that are optimized to balance the forces from the compressor, thus minimizing side-to-side motion of the compressor and keeping the motion of the compressor linear in the vertical direction. The vertical linear motion minimizes stress concentrations in the base pan and minimizes torsional stresses in associated connection tubing. The resulting structure also dampens harmonics that may amplify during transit of the system. The tiered multi-level design also ensures that any water on the base pan surface drains toward the outside of the base pan. It has to be noted that the base pan design can consist of a single piece construction encompassing both outdoor section SP1 and indoor section SP2.

Alternatively, the base pan design can be a dedicated outdoor section SP1 base pan.

Numbered examples of the above embodiments include:

1. A heating, ventilation, and air conditioning (HVAC) system comprising: one or more compressors; one or more outdoor heat exchangers; one or more indoor heat exchangers; and a base pan on which the one or more compressors are mounted and comprising a base level and one or more tier levels higher than the base level, wherein a distance from any point on a perimeter of the first tier level to a nearest point on a perimeter of the base level is based on the smallest bolt circle diameter of the one or more compressors and the tier level perimeter lengths are based on a percentage of the base level perimeter length.
2. The system of example 1, wherein the distance from any point on the perimeter of the first tier level to the nearest point on the perimeter of the base level is equal to two times the smallest bolt circle diameter or less.
3. The system of example 2, wherein the distance from any point on the perimeter of the first tier level to the nearest point on the perimeter of the base level is equal to the smallest bolt circle diameter or less.
4. The system of example 1, wherein the base pan further comprises more than one tier level and the distance from any point on the perimeter of each tier level and the nearest point on the perimeter of the adjacent tier level is based on the smallest bolt circle diameter.
5. The system of example 4, wherein the distance from any point on the perimeter of each tier level and the nearest point on the perimeter of the adjacent tier level is equal to the smallest bolt circle of the compressor or less.
6. The system of example 4, wherein the distance from any point on the perimeter of each tier level and the nearest point on the perimeter of the adjacent tier level is equal to half the smallest bolt circle of the compressor or less.

7. The system of example 1, wherein the base pan further comprises more than one tier level and each tier level perimeter length is based on a percentage of the base level perimeter length.
8. The system of example 7, wherein the percentage of the base level perimeter length for each tier level perimeter length is selected based on the tier level number.
9. The system of example 8, wherein the percentage of the base level perimeter length of each tier level is determined based on the particular tier level number and expressed by the formula:

$$\%\text{ of length of base level } perimter = 1-(0.2+.15*(\text{tier level number})),\text{ including } +/-5\%.$$

10. The system of example 7, wherein the percentages of the base level perimeter length for the tier levels ranges from 15-70%.
11. The system of example 10, wherein the percentage of the base level perimeter length is selected from the group consisting of 60-70%, 45-55%, 30-40%, and 15-25%.
12. The system of example 10, wherein the percentage of the base level perimeter length for the first tier level is 60-70%.
13. The system of example 1, wherein the base pan further comprises one or more compressor structural supports and the distance from a center of any of the one or more compressors to the closest compressor structural support is equal to two times the smallest bolt circle diameter or less.
14. The system of example 1, wherein the base pan further comprises one or more compressor structural supports and the distance from a center of any of the one or more compressors to the closest compressor structural support is equal to the smallest bolt circle diameter or less.
15. The system of example 1, wherein the vertical forces of the one or more compressors are evenly distributed on the base pan.
16. The system of example 1, further comprising an outdoor section including the one or more compressors and one or more outdoor heat exchangers and an indoor section including the one or more indoor heat exchangers, and wherein the base pan only supports the outdoor section.
17. The system of example 1, further comprising an outdoor section including the one or more compressors and one or more outdoor heat exchangers and an indoor section including the one or more indoor heat exchangers, and wherein the base pan supports the outdoor section and the indoor section.
18. A base pan for a heating, ventilation, and air conditioning (HVAC) system comprising one or more compressors to be mounted on the base pan, the base pan comprising a base level and one or more tier levels higher than the base level, wherein a distance from any point on a perimeter of the first tier level to a nearest point on a perimeter of the base level is based on the smallest bolt circle diameter of the one or more compressors and the tier level perimeter lengths are based on a percentage of the base level perimeter length.
19. The base pan of example 18, wherein the distance from any point on the perimeter of the first tier level to the nearest point on the perimeter of the base level is equal to two times the smallest bolt circle diameter or less.
20. The base pan of example 19, wherein the distance from any point on the perimeter of the first tier level to the nearest point on the perimeter of the base level is equal to the smallest bolt circle diameter or less.
21. The base pan of example 18, wherein the base pan further comprises more than one tier level and the distance from any point on the perimeter of each tier level and the nearest point on the perimeter of the adjacent tier level is based on the smallest bolt circle diameter.
22. The system of example 21, wherein the distance from any point on the perimeter of each tier level and the nearest point on the perimeter of the adjacent tier level is equal to the smallest bolt circle of the compressor or less.
23. The system of example 21, wherein the distance from any point on the perimeter of each tier level and the nearest point on the perimeter of the adjacent tier level is equal to half the smallest bolt circle of the compressor or less.
24. The base pan of example 18, wherein the base pan further comprises more than one tier level and each tier level perimeter length is based on a percentage of the base level perimeter length.
25. The base pan of example 24, wherein the percentage of the base level perimeter length for each tier level perimeter length is selected based on the tier level number.
26. The system of example 25, wherein the percentage of the base level perimeter length of each tier level is determined based on the particular tier level number and expressed by the formula:

$$\%\text{ of length of base level } perimter = 1-(0.2+.15*(\text{tier level number})),\text{ including } +/-5\%.$$

27. The base pan of example 24, wherein the percentages of the base level perimeter length for the tier levels ranges from 15-70%.
28. The base pan of example 27, wherein the percentage of the base level perimeter length is selected from the group consisting of 60-70%, 45-55%, 30-40%, and 15-25%.
29. The base pan of example 27, wherein the percentage of the base level perimeter length for the first tier level is 60-70%.
30. The base pan of example 18, wherein the base pan further comprises one or more compressor structural supports positioned such that the distance from the compressor structural support to a center of the compressor to be mounted on the compressor structural support is equal to two times the smallest bolt circle diameter or less.
31. The base pan of example 18, wherein the base pan further comprises one or more compressor structural supports positioned such that the distance from the compressor structural support to a center of the compressor to be mounted on the compressor structural support is equal to the smallest bolt circle diameter or less.

32. The base pan of example 18, wherein the base pan is sized and shaped such that the vertical forces of the one or more compressors are evenly distributed on the base pan when mounted.

33. The base pan of example 18, wherein the HVAC system further comprises an outdoor section including the one or more compressors and an indoor section comprising one or more indoor heat exchangers, and wherein the base pan only supports the outdoor section.

34. The base pan of example 18, wherein the HVAC system further comprises an outdoor section including the one or more compressors and an indoor section comprising one or more indoor heat exchangers, and wherein the base pan supports the outdoor section and the indoor section.

Certain terms are used throughout the description and claims to refer to particular features or components. As one skilled in the art will appreciate, different persons may refer to the same feature or component by different names. This document does not intend to distinguish between components or features that differ in name but not function.

The embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to suggest that the scope of the disclosure, including the claims, is limited to that embodiment.

What is claimed is:

1. A heating, ventilation, and air conditioning (HVAC) system comprising:

one or more compressors;

one or more outdoor heat exchangers;

one or more indoor heat exchangers; and a base pan configured for mounting one or more compressors thereon and comprising a base level and one or more tier levels higher than the base level, wherein a distance from any point on a perimeter of the first tier level to a nearest point on a perimeter of the base level is based on the smallest bolt circle diameter of the one or more compressors and the tier level perimeter lengths are based on a percentage of the base level perimeter length.

2. The system of claim 1, wherein the distance from any point on the perimeter of the first tier level to the nearest point on the perimeter of the base level is equal to two times the smallest bolt circle diameter or less.

3. The system of claim 2, wherein the distance from any point on the perimeter of the first tier level to the nearest point on the perimeter of the base level is equal to the smallest bolt circle diameter or less.

4. The system of claim 1, wherein the base pan further comprises more than one tier level and the distance from any point on the perimeter of each tier level and the nearest point on the perimeter of an adjacent tier level is based on the smallest bolt circle diameter.

5. The system of claim 4, wherein the distance from any point on the perimeter of each tier level and the nearest point on the perimeter of an adjacent tier level is equal to the smallest bolt circle of the compressor or less.

6. The system of claim 4, wherein the distance from any point on the perimeter of each tier level and the nearest point on the perimeter of an adjacent tier level is equal to half the smallest bolt circle of the compressor or less.

7. The system of claim 1, wherein the base pan further comprises more than one tier level and each tier level perimeter length is based on a percentage of the base level perimeter length.

8. The system of claim 7, wherein the percentage of the base level perimeter length for each tier level perimeter length is selected based on the tier level number.

9. The system of claim 8, wherein the percentage of the base level perimeter length of each tier level is determined based on the particular tier level number and expressed by:

$$\%\text{ of length of base level } \textit{perimter} = 1-(0.2+.15*(\text{tier level number})),\text{ including } +/-5\%.$$

10. The system of claim 7, wherein the percentages of the base level perimeter length for the tier levels ranges from 15-70%.

11. The system of claim 10, wherein the percentage of the base level perimeter length is selected from the group consisting of 60-70%, 45-55%, 30-40%, and 15-25%.

12. The system of claim 10, wherein the percentage of the base level perimeter length for the first tier level is 60-70%.

13. The system of claim 1, wherein the base pan further comprises one or more compressor structural supports and the distance from a center of any of the one or more compressors to the closest compressor structural support is equal to two times the smallest bolt circle diameter or less.

14. The system of claim 1, wherein the base pan further comprises one or more structural supports and the distance from a center of any of the one or more compressors to the closest structural support is equal to the smallest bolt circle diameter or less.

15. The system of claim 1, wherein vertical forces of the one or more compressors are evenly distributed on the base pan.

16. The system of claim 1, further comprising an outdoor section including the one or more compressors and one or more outdoor heat exchangers and an indoor section including the one or more indoor heat exchangers, and wherein the base pan only supports the outdoor section.

17. The system of claim 1, further comprising an outdoor section including the one or more compressors and one or more outdoor heat exchangers and an indoor section including the one or more indoor heat exchangers, and wherein the base pan supports the outdoor section and the indoor section.

18. A base pan for a heating, ventilation, and air conditioning (HVAC) system, wherein the base pan is configured for mounting one or more compressors thereon, and the base pan comprising a base level and one or more tier levels higher than the base level, wherein a distance from any point on a perimeter of the first tier level to a nearest point on a perimeter of the base level is based on the smallest bolt circle diameter of the one or more compressors and the tier level perimeter lengths are based on a percentage of the base level perimeter length.

19. The base pan of claim 18, wherein the distance from any point on the perimeter of the first tier level to the nearest point on the perimeter of the base level is equal to two times the smallest bolt circle diameter or less.

20. A method for manufacturing a base pan for mounting one or more compressors of a heating, ventilation, and air-conditioning ("HVAC"), the method comprising:

configuring the base pan to comprise a base level and one or more tier levels higher than the base level;

determining a distance from any point on a perimeter of the first tier level to a nearest point on a perimeter of the base level based on the smallest bolt circle diameter of the one or more compressors; and determining the tier level perimeter lengths based on a percentage of the base level perimeter length.

* * * * *